US006371746B1

(12) United States Patent
Shiomi et al.

(10) Patent No.: US 6,371,746 B1
(45) Date of Patent: Apr. 16, 2002

(54) METHOD OF ELECTRONIC SINTERING METHOD AND MOLD FOR USE IN THE METHOD

(75) Inventors: Yasuaki Shiomi, Ryugasaki; Nobuhito Kuroishi, Matsudo; Shigeru Tsuboi, Tsukuba; Atsushi Sugai, Ibaraki; Masahiro Murata, Osaka; Jun Yoshino, Ushiku, all of (JP)

(73) Assignee: Kubota Corporation (JP)

( * ) Notice: Subject to any disclaimer, the term of this patent is extended or adjusted under 35 U.S.C. 154(b) by 0 days.

(21) Appl. No.: 09/502,623

(22) Filed: Feb. 11, 2000

(30) Foreign Application Priority Data

Feb. 12, 1999 (JP) ..... 11-033618
Feb. 12, 1999 (JP) ..... 11-033619
Feb. 3, 2000 (JP) ..... 2000-026215

(51) Int. Cl.[7] ..... B22F 3/14
(52) U.S. Cl. ..... 425/78; 419/52
(58) Field of Search ..... 425/78; 419/52

(56) References Cited

U.S. PATENT DOCUMENTS 3,656,946 A * 4/1972 Inque et al. ..... 75/226
3,873,805 A * 3/1975 Inoue ..... 219/149
4,273,581 A * 6/1981 Inoue ..... 75/214

* cited by examiner

*Primary Examiner*—Daniel J. Jenkins
(74) *Attorney, Agent, or Firm*—Webb Ziesenheim Logsdon Orkin & Hanson, P.C.

(57) ABSTRACT

An electric sintering mold includes a clamping portion for clamping a powder material, the material clamped by the clamping portion being subjected to a pressure from a pressurizer and a pulsating electric current externally supplied, so that joule heat is generated within the material for sintering the material. The mold is formed of material containing metal boride having electroconductivity. An electric sintering apparatus using such mold and an electric sintering method utilizing such apparatus and mold are also disclosed.

10 Claims, 3 Drawing Sheets

METHOD OF ELECTRONIC SINTERING METHOD AND MOLD FOR USE IN THE METHOD

BACKGROUND OF THE INVENTION

Field of the Invention

The present invention relates to a method of electric sintering and a mold for use in such method, and relates more particularly to the art of electric sintering utilizing plasma discharge, pulsating current, etc.

More specifically, the invention relates to an electric sintering mold having a clamping portion capable of clamping the powder material, the clamped material being sintered by the joule heat generated within the material in response to an externally supplied pulsating current and a pressure applied to the material from a pressurizer. The invention also relates to an electric sintering mold of a type including a die defining a cavity for receiving the powder material and a punch capable of advancing into the die cavity. The invention relates also to an electric sintering method using such mold. The invention further relates to an electric sintering apparatus including a die defining a cavity for receiving the powder material, a punch capable of advancing into the die cavity, a pair of electrodes capable of sending a current to the powder material received within the die, and a power supply unit capable of supplying a pulsating current to the pair of electrodes.

Description of the Related Art

In the art of electric sintering described above, for reducing the time required for sintering the powder material, the prior art has proposed a method of sintering the powder material by utilizing joule heat generated within the material in response to a pulsating current applied to the material in cooperation with a pressure also applied to the material from a pressurizer. Referring more particularly to this method, the powder material is charged in a die and then this die holding the material therein is clamped between a pair of upper and lower punches, and the material is pressurized and at the same time the pulsating current is applied to the layer of the powder material within the die, whereby joule heat is generated within the material, which heat, in cooperation with the pressure, sinters the material. With such electric sintering method, the time required for sintering the material may be reduced advantageously, in comparison with the more conventional method of sintering material in furnace atmosphere which requires hours until completion of sintering.

The sintering mold employed for such method as above requires high electroconductivity for allowing the externally supplied current to be smoothly conducted to the material via the mold and requires also sufficient mechanical strength under high temperature condition since the mold must be able to withstand the high temperature generated in the material held within the mold and must also be able to transmit the high pressure from the pressurizer to the material held within the mold.

Then, as material suitable for forming such mold satisfying both of the requirements of high electroconductivity and high mechanical strength under high temperature condition, the prior art has proposed e.g. graphite or WC—Co which is a superhard material.

In recent years, there is an increasing demand for forming products or components by means of sintering. In particular, such components as a piston head for an automobile engine has been manufactured by sintering. In this regard, with the conventionally proposed electric sintering method described above, if the material to be sintered is highly conductive material such as aluminum, a significant electric current density is required to obtain a large amount of joule heat. Hence, unless the electric power supply unit is capable of supplying an extremely large amount of current, it will take a long time for the material to reach its sintering temperature. With a typical power supply unit, the sintering operation takes as much as half an hour to be completed. In this manner, according to the conventional art, if improvement in the turn around time is desired, this is possible only with enlargement of the system and resultant increase of system costs. That is, in quest for more efficient sintering suitable for mass-produced articles, there has been the continuing need for minimizing their processing cycle. And, this should be made possible without inviting enlargement of the system, from the view point of manufacture costs.

In addition, the conventional electric sintering mold made of graphite, WC—Co or the like has the further disadvantage that the inner surface of the mold tends to erode gradually due to physical and/or chemical reaction occurring in the powder material when placed under the high temperature and pressure condition therein.

For this reason, in order for the mold to be usable for a plurality of times while maintaining its inner dimension, that is, as high as possible dimensional accuracy of the compact to be obtained therefrom, it would be needed to apply a mold releasing agent such as boron nitride (BN) powder or spray or carbon powder to the inner surface of the mold (generally, to the inner surface of the die and also to the pressing surface of the punch) for each run prior to charging of the material therein. More particularly, after completion of each sintering operation, before starting the next run, the operator must additionally carry out the troublesome maintenance operation of checking the inner dimension and the surface condition of the mold and then reapplying new releasing agent when he/she finds the mold unusable for the next run. In this respect, there remains room for improvement.

Moreover, even with use of such releasing agent, the conventional graphite or WC—Co mold still has a rather limited service life, which is unsatisfactory from the economical point of view. Presumably, this is because the releasing agent cannot fully block the physical and/or chemical reaction of the charged powder material occurring under the high temperature and pressure condition.

Accordingly, in view of the above-described shortcomings of the prior art, a primary object of the present invention is to provide a further improved electric sintering method and apparatus which enable highly efficient electric sintering operation by minimizing the time required for sintering operation without increasing the current capacity of the power supply unit, providing good releasing of the molded product from the mold after sintering without the need of applying a releasing agent prior to charging of the power material for sintering therein, and also by providing longer service life than the conventional graphite or WC—Co type electric sintering mold.

SUMMARY OF THE INVENTION

For accomplishing the above-noted object, according to one aspect of the invention, there is provided an electric sintering mold which contains metal boride having electroconductivity.

For example, this electric sintering mold of the invention may be provided in the form of a compact containing metal boride having high electroconductivity, plus other optional component such as refractory material (e.g. oxide such as $SiO_2$, $Al_2O_3$, etc; carbide such as SiC; nitride such as SIALON, $Si_3N_4$, etc.). Then, with this mold, the electric current externally supplied thereto may be converted in a very efficient manner through this mold into joule heat to be generated within the powder material held therein. Further, as this mold has a higher mold-releasing performance than the conventional graphite or WC—Co molds, the invention's mold is free from the need of applying a releasing agent to the mold prior to charging of the power material therein. Moreover, even without application of such releasing agent at all, this mold can still provide greater durability, i.e. longer service life than the conventional molds described above.

According to another aspect of the invention, there is provided an electric sintering mold comprising: a die defining a cavity capable of receiving powder material therein; and a punch capable of advancing into the cavity of the die, the powder material held within the cavity of the die being subjected to a pressure from the punch and also to an externally supplied pulsating electric current so that joule heat is generated within the powder material for sintering the material; wherein at least one of the punch and the die is made of a material which contains metal boride having electroconductivity.

In this case too, the electric sintering mold of the invention may be provided in the form of a compact containing metal boride having high electroconductivity and other additional component such as refractory material (e.g. oxide such as $SiO_2$, $Al_2O_3$, etc; carbide such as SiC; nitride such as SIALON, $Si_3N_4$, etc.). Then, with this mold, the electric current externally supplied thereto may be converted in a very efficient manner through this mold into joule heat to be generated within the powder material held therein. Further, as this mold has a higher mold-releasing performance than the conventional graphite or WC—Co molds, the invention's mold is free from the need of applying a releasing agent to the mold prior to charging of the power material therein. Moreover, even without application of such releasing agent at all, this mold can still provide greater durability, i.e. longer service life than the conventional molds described above.

According to the invention, the material forming the die and/or the punch has an electric resistivity ranging from $10\times10^{-7}$ to $10\times10^{-1}$ ($\Omega$cm). This setting provides even more efficient conversion of the pulsating current into the joule heat within the powder material held in the mold.

Also preferably, according to the invention, the material forming the die and/or the punch has Vickers hardness ranging from 10 to 50 (GPa). This setting provides the material with even higher mechanical strength for restricting "biting-in" of the powder material into the inner surface of the mold in response to the pressure applied from the pressurizer, thus achieving still longer useful life of the mold as well as higher dimensional accuracy in the sintered compact obtained.

Preferably, according to the invention, the metal boride comprises titanium diboride. Titanium diboride is most suitable for its low electric resistivity and high Vickers hardness.

According to a still further aspect of the present invention, there is provided an electric sintering method characterized in that the powder material is preheated prior to the sintering operation thereof within the die.

With the above method, the powder material is preheated prior to its sintering operation. Hence, this method can reduce the time required for heating the material up to the sintering temperature, so that the sintering operation may be completed within a very short time period.

Preferably, according to the invention, in the method described above, the powder material is preheated to a temperature which is below the fusing temperature of the powder material and which also is higher than 40% of the electric sintering temperature in the Celsius scale.

If the powder material is preheated in the range specified above, the time period required for sintering operation may be further reduced. In addition to this advantage of speeding up the sintering operation, the preheating of the powder material provides another advantage of reducing the deformation resistance of the material so as to make it easier for the material to be compressed with higher density. Incidentally, if the preheating temperature is set lower, this will prevent disadvantageous growth of large metal crystals during this preheating operation. However, if the preheating operation is completed within a short time period, this will not allow time for growth of such large metal crystals. Therefore, disadvantageous enlargement of metal crystals may be avoided even with high preheating temperature. For this reason, its is preferred that the preheating operation be completed within the shortest possible time period at the highest possible temperature. In this respect, it should noted, however, that the preheating temperature should not be as high as or even too near the fusing temperature of the powder material so as to avoid "premature" sintering of the material at this preheating stage. If the current and pressure are applied the powder material after such preheating operation thereof, this powder material may be sintered within a very short time period.

According to the invention, the preheating operation is effected on the die holding the powder material therein prior to its electric sintering operation.

The above construction can prevent cooling of the preheated powder material by the die. Hence, the subsequent operation of externally supplying the electric current to the preheated powder material may be effected even more efficiently. Consequently, the sintering time period may be still further reduced.

According to a still further aspect of the invention, there is provided an electric sintering apparatus wherein the die thereof includes preheating means, as second heating means, capable of preheating the powder material held in the die or the die per se and then maintaining the powder material at the preheated temperature until the subsequent electric sintering operation of the powder material.

With the above-described construction, when the powder material held in the die may be preheated and then maintained at the preheating temperature without being cooled until its sintering operation. Hence, the subsequent electric sintering operation may be carried out efficiently in a further reduced time period. As described hereinbefore, in addition to the reduction in the sintering time, the preheating provides the further advantage of reducing the deformation resistance of the powder material, which allows higher density of the material when compacted. Further, if the sintering operation is effected under vacuum, the powder material may be charged into the die disposed inside the vacuum chamber. Then, this material may be pressurized by the punch and supplied with the current to be sintered thereby. In such case, since the preheating means is incorporated within the die, when the powder material is preheated within this die, the heat-resistive layer may be formed thin, so that good heating efficiency may be maintained.

Consequently, the invention has achieved its primary object of providing an electric sintering method and apparatus suitable for mass-production, by reducing the cycle time of the sintering process without inviting increase in the current capacity of the electric power supply unit.

According to the invention, in the electric sintering apparatus described above, the apparatus may include the electric sintering mold.

With the above construction, namely, if the electric sintering mold, is provided in the invention's apparatus capable of reducing the cycle time of sintering operation by preheating the powder material held in the die or the die itself without increasing the current capacity of the power supply unit, the same functions and effects as the mold described hereinbefore may be attained, so that such apparatus may effect its electric sintering operation even more efficiently.

Further and other aspects, features and advantages of the invention will become apparent from the following detailed description of the preferred embodiments thereon in conjunction with the accompanying drawings.

BRIEF DESCRIPTION OF THE DRAWINGS

The accompanying drawings show pulsating electric current sintering apparatuses relating to the preferred embodiments of this invention, in which.

DESCRIPTION OF THE PREFERRED EMBODIMENTS (Construction of a Pulsating Electric Current Sintering Apparatus)

Figure 1:
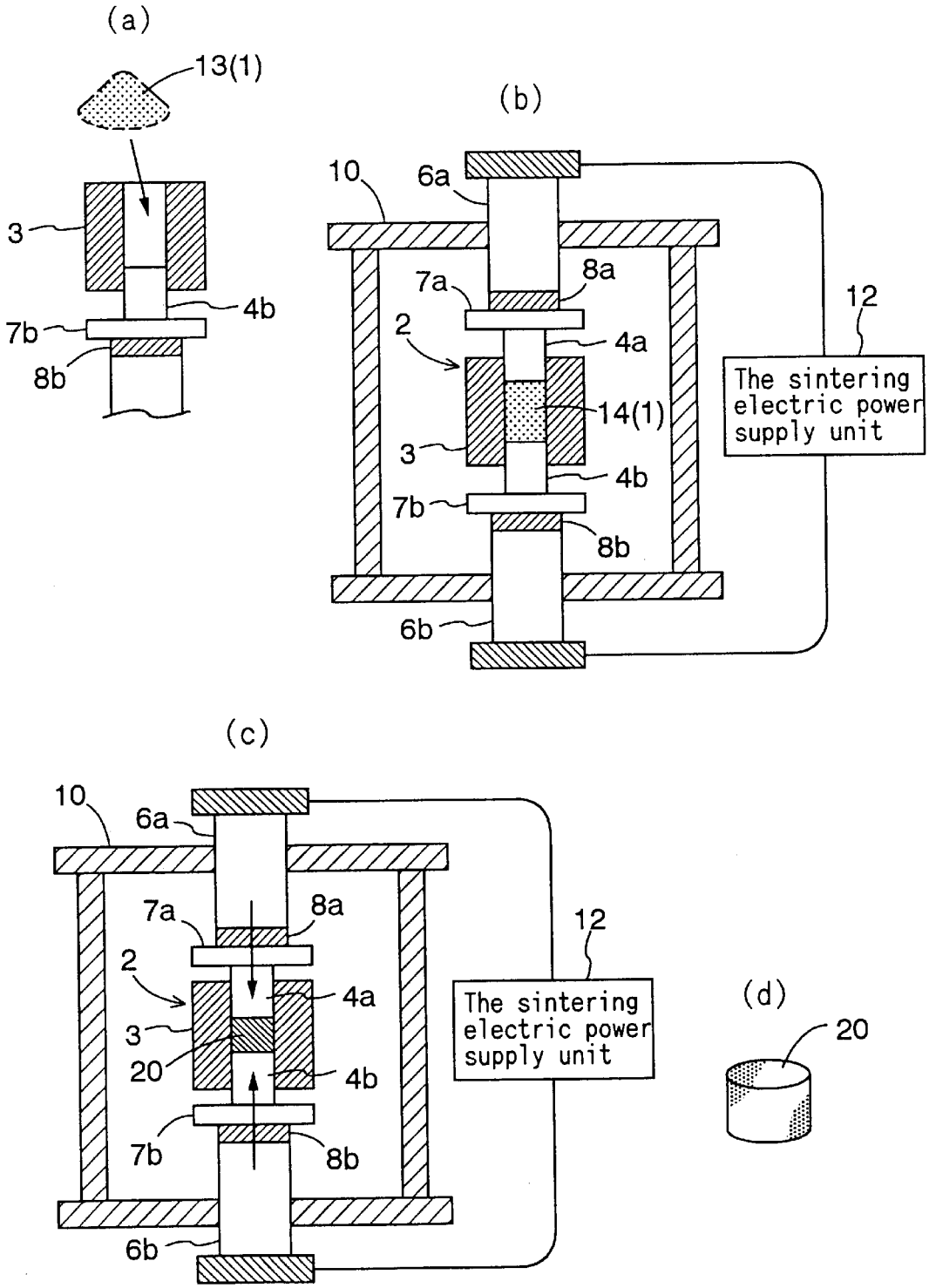
FIG. 1 is a conceptual view showing a pulsating electric current sintering apparatus using an electric sintering mold according to one preferred embodiment of the invention.

As shown in FIG. 1, an electric sintering apparatus relating to one preferred embodiment of the invention includes an electric sintering mold 2 consisting essentially of a sintering die 3 capable of holding powder material 1 therein and sintering the material under pressure and a pair of punches 4*a*, 4*b* for pressurizing a powder-material layer 14 filled with the powder material 1 charged into the die 3, a pair of punch electrodes 8*a*, 8*b* capable of communicating an electric current to the material layer 14 inside the die 3, and a sintering electric power supply unit 12 capable of supplying the electric current to the pair of punch electrodes 8*a*, 8*b*. The sintering die 3 is provided in the form of a cylindrical member which is conventionally made of material, e.g. cermet, having high electrical resistivity as well as high thermal shock resistance. Into this die 3, the pair of punches 4*a*, 4*b* are to be inserted from the above and below.

The electric sintering mold 2 is disposed between the upper and lower punch electrodes 8*a*, 8*b* via a pair of press plates 7*a*, 7*b* made of e.g. electroconductive refractory metal.

Each of the punches 4*a*, 4*b* is provided in the form of a column-like member made conventionally of heat-resistant material such as tungsten, molybdenum, etc. And, the pair of punch electrodes 8*a*, 8*b* are electrically connected with these punches 4*a*, 4*b*, respectively. The pair of punch electrodes 8*a*, 8*b* provide "first heating means".

The above-described components of the electric sintering apparatus, i.e. the sintering die 3, the upper and lower punches 4*a*, 4*b*, and the pair of punch electrodes 8*a*, 8*b* connected with the punches 4*a*, 4*b* are housed together within a vacuum chamber 10 which is water-cooled. The apparatus further includes pressurizing mechanisms 6*a*, 6*b* provided at the bottom portion and the ceiling portion of the vacuum chamber 10 for pressing the opposed punches 4*a*, 4*b* to approach each other.

(Electric Sintering Mold)

Figure 2:
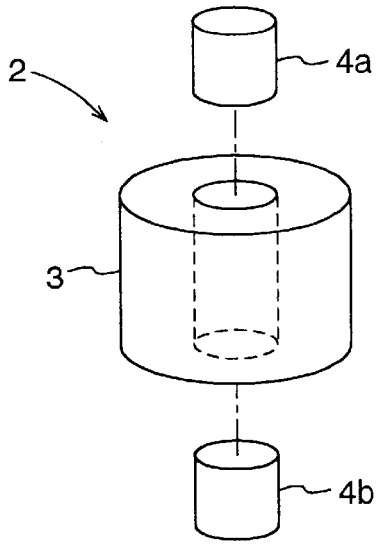
FIG. 2 is a perspective view of the electric sintering mold.

Referring now to FIG. 2, the electric sintering mold 2 consists essentially of the sintering die 3 and the upper and lower punches 4*a*, 4*b*. The sintering die 3 is a cylindrical member having an inner diameter of 20 mm ϕ, an outer diameter of 55 mm ϕ and a height of 40 mm. Each of the upper and lower punches 4*a*, 4*b* is a column-like member having an outer diameter of 20 mm ϕ and a height of 20 mm. The leading end of each of the upper and lower punches 4*a*, 4*b* provides a plunger portion capable of advancing into the inner-diameter portion of the sintering die 3.

Both the sintering die 3 and the upper and lower punches 4*a*, 4*b* are compact components made of titanium diboride ($TiB_2$) and having a density which amounts to about 90% or more of the theoretical density, an electrical resistivity of about $12\times10^{-6}$ Ωcm, and a Vickers hardness of about 26 GPa. These compact components may be made by such method as the atmospheric calcination method or hot pressing under certain molding conditions (particle diameter of titanium diboride, heating-pressurizing condition, etc.) which conditions per se are well-known to one having ordinary skill in the art. Incidentally, a sample of such compact made of titanium diboride ($TiB_2$) obtained by the same method has a bending strength of 700 MPa in inactive atmosphere at 500° C.

(Embodiment 1 of Electric Sintering Mold)

By using the pulsating electric current sintering apparatus described above and the electric sintering mold 2 of the invention, an electric sintering operation was carried out in the following manner, in which aluminum alloy powder material 13 made of an aluminum alloy (e.g. Al-12Si) was employed as an example of the powder material 1.

<1> The aluminum alloy powder material 13 (having the average particle diameter of 400 μm) as the material to be electrically sintered is cool-charged into a space formed by the die 3 and the lower punch 4*b* shown in FIG. 1 (see FIG. 1*a*). The amount of this aluminum alloy powder material 13 may be about 5 g for instance.

<2> Next, the upper punch 4*a* is forcibly inserted into the inner-diameter portion of the sintering die 3 from above the power-material layer 14 formed of the aluminum alloy powder material 13 charged as above (see FIG. 1*b*). In the foregoing steps, no mold releasing agent at all is applied to the inner surface of the die 3 or the pressing faces of the upper and lower punches 4*a*, 4*b*.

<3> A pressure of 150 MPa approximately is applied to the alloy powder by using a hydraulic pressurizing unit (see FIG. 1*c*).

<4> While maintaining the pressurizing of about 150 MPa to the alloy powder held inside the electric sintering mold 2, the alloy powder material is heated to a predetermined temperature (500° C.) at the temperature elevating rate of about 40° C./min. In this heating operation, an electric current is supplied to the powder material layer 14 formed of the aluminum alloy powder material 13 charged into the sintering die 13 through the upper and lower punch electrodes 8*a*, 8*b* connected to the sintering electric power supply unit 12 so as to generate joule heat within the aluminum alloy powder material 13 per se, by which heat this material is sintered (this joule heat is generated at a portion having especially high electric resistivity, i.e. the interfaces between the particles of the powder material).

<5> After completion of the sintering process described above, the sintered compact of the alloy powder is removed from the die 3 by means of the pressurizing unit with the aid of the upper and lower punches 4*a*, 4*b* as well as an auxiliary plunger (not shown) when needed (see FIG. 1*d*).

The sintering die 3 defines, in a lateral face thereof, a through hole (not shown) for enabling temperature detection, so that a temperature detector such as a thermocouple may be inserted through this through hole to come into contact with the material inside the die 3. Therefore, by controlling the amount of the pulsating current from the electric power supply unit 12 based on the result of this temperature detection, the temperature may be elevated or maintained with accurate control.

(Durability of the Electric Sintering Mold)

A number of pulsating electric current sintering operations were experimentally conducted in repetition on the aluminum alloy powder material 13 made of Al-12Si in accordance with the above-described procedure and using the sintering die 3 of the invention and the upper and lower punches 4*a*, 4*b*. As a result, the mold could endure several hundred cycles of electric sintering and mold releasing operations of the Al-12Si alloy powder without any application at all of releasing agent to the inner surface of the mold or elsewhere.

(Embodiment 2 of the Electric Sintering Mold)

In this embodiment, the same electric sintering mold 2 as the foregoing example was employed. By using the pulsating electric current sintering apparatus described above, ferrous amorphous powder material was electrically sintered according basically to the same procedure as the embodiment 1. In this case, however, since amorphous powder material has high hardness and high sintering resistance, its high-density (theoretical density of 80% or higher) preform was obtained only when the pressure to be applied to the metal powder by the hydraulic pressurizer unit was set to about 500 MPa (temperature: 400° C.).

Incidentally, in the case of comparison experiments using the conventional mold made of graphite or WC—Co, it was not possible to apply pressure exceeding 150 MPa to such mold, due to its insufficient mechanical strength. Therefore, such high-density (i.e. theoretical density of 80% or higher) preform could not be obtained from the amorphous powder material, by using the conventional graphite or WC—Co mold.

(Embodiment 3 of Electric Sintering Mold)

By using the same pulsating current sintering mold as above, with the sintering die 3 comprising a compact of titanium diboride and also the respective punches 4*a*, 4*b* made of alloy tool steel, SKD61, aluminum alloy powder material 13 of Al-12Si was electrically sintered according basically to the same procedure as the foregoing embodiment 1. As a result, a high-density (theoretical density higher than 90% ) was obtained. And, several hundred cycles of such electric sintering operations and mold releasing operations of the Al-12Si alloy molded products could be conducted without application of any releasing agent at all to the inner surface of the mold or elsewhere.

(Embodiment 4 of Electric Sintering Mold)

As the material for forming the electric sintering mold 2, there was formed a compact containing titanium diboride with 50 wt. % of silicon carbide added thereto. This material exhibited density of about 90% or higher, electrical resistivity of about $34\times10^{-5}$ Ωcm, and Vickers hardness of about 24 GPa. Then, by using the sintering die 3 and the respective punches 4*a*, 4*b* made of such material, the aluminum alloy powder material 13 of Al-12Si was electrically sintered according basically to the same procedure as the foregoing embodiment 1. As a result, several hundred cycles of electric sintering operations and mold releasing operations of the Al-12Si alloy molded products could be conducted without application of any releasing agent at all to the inner surface of the mold or elsewhere.

(Other Embodiments of the Electric Sintering Mold)

<1> The sintering die 3 or the upper and lower punches 4*a*, 4*b* made of titanium diboride employed in the foregoing embodiments may be formed of block-like compacts by means of electric spark machining utilizing the electroconductivity of titanium diboride.

<2> As the raw material for forming the electric sintering mold, any other metal boride (e.g. zirconium boride) other than titanium diboride ($TIB_2$) may be employed, as long as such other material has the electrical resistivity ranging from $10\times10^{-7}$ to $10\times10^{-1}$ (Ωcm) and Vickers hardness ranging between 10 and 50 GPa. Further, a filler made of refractory material (e.g. oxide such as $SiO_2$, $Al_2O_3$, etc; carbide such as SiC; nitride such as SIALON, $Si_3N_4$, etc.) may be added to such raw material.

Electrical resistivity values and Vickers hardness values of such mixture materials of titanium diboride ($TIB_2$) and refractory materials other than metal boride are listed in Table 1 below

TABLE 1

[electrical resistivity and Vickers hardness of material compositions for forming electric sintering mold]

| material composition | density (g/cc) | Vickers hardness (HV) | actual electrical resistivity (Ω cm) |
|---|---|---|---|
| $TiB_2$ | 4.49–4.51 | 24–27 | $10.2–11.8 \times 10^{-6}$ |
| $TiB_2$-25% SiC | 4.04–4.06 | 23–27 | $91.7–97.1 \times 10^{-6}$ |
| $TiB_2$-50% SiC | 3.53–3.55 | 22–26 | $33.3–34.1 \times 10^{-5}$ |
| $TiB_2$-55% SiC | 3.42–3.45 | 22–26 | $20.1–20.5 \times 10^{-4}$ |
| $TiB_2$-60% SiC | 3.33–3.32 | 21–25 | $29.8–30.0 \times 10^{-3}$ |
| $TiB_2$-75% SiC | 3.09–3.10 | 21–24 | 71.4 |
| $TiB_2$-23% $Si_3N_4$ | 3.46–3.50 | 18–22 | $11.2–11.6 \times 10^{-5}$ |
| $TiB_2$-68% $Si_3N_4$ | 3.10–3.22 | 15–19 | $73.3–74.4 \times 10^{-5}$ |
| SKD (comparison example) | | | $48.5–54.5 \times 10^{-5}$ |
| graphite (comparison example) | | | $33.7–34.1 \times 10^{-4}$ |

As may be understood from Table 1 above, those mixture materials of titanium diboride ($TIB_2$) added with about 60 wt. % or less of SiC and about 68 wt. % or less of $Si_3N_4$ had electrical resistivity values within the desirable range. Thus, with use of these materials, the externally supplied pulsating current may be converted into the joule heat in the powder material held inside the mold in a very efficient manner.

Further, all of these materials identified in Table 1 that contain titanium diboride ($TiB_2$) had Vickers hardness values within the desirable range also. Thus, with use of these materials, the "bite-in" phenomenon of the powder material into the inner mold surface under the applied pressure may be effectively avoided. So that, the mold may provide sufficiently long service life and sufficiently high dimensional accuracy of the molded products for such extended service life.

Figure 3:
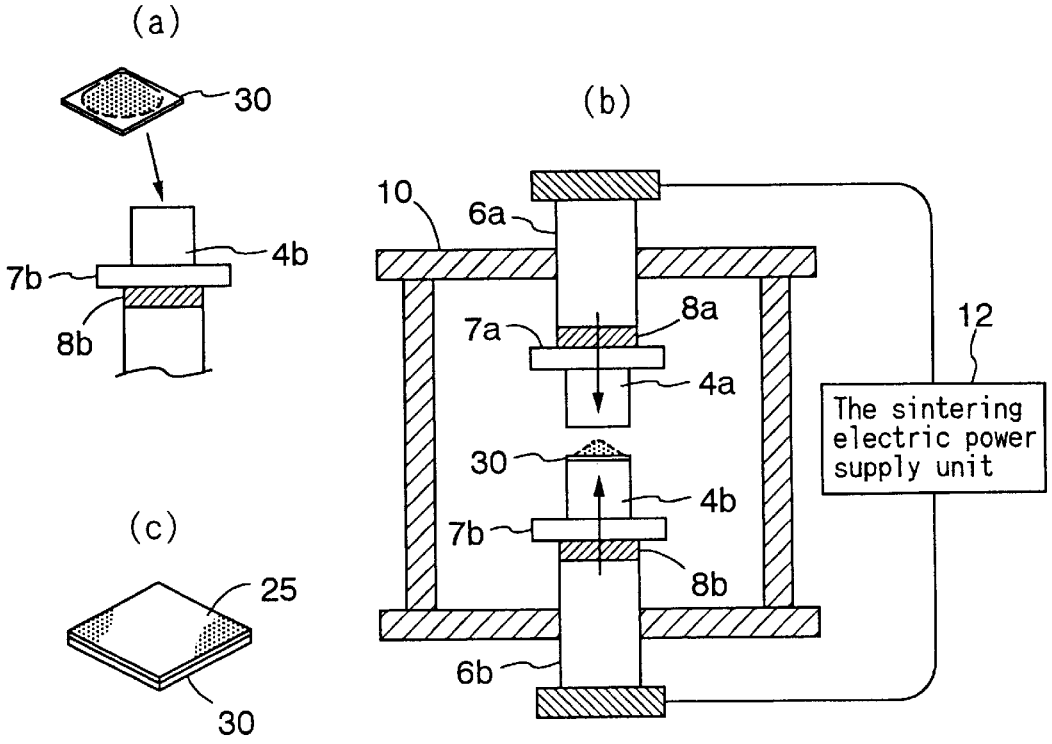
FIG. 3 is a conceptual view showing a pulsating electric current sintering apparatus using an electric sintering mold according to another preferred embodiment of the invention.

<3> As shown in FIG. 3, the electric sintering mold may alternatively be constructed without the sintering die 3, so that this apparatus comprises only the upper and lower punches 4*a*, 4*b* mounted therein.

In this case, the metal powder material in an amount smaller than the amount employed in the foregoing embodiment 1 or 2 will be placed, in the form of a thin layer, on an existing metal plate 30 (see FIG. 3*a*). Then, this metal plate 30 together with the metal powder material layer placed thereon will be clamped between the clamping portions 15 of the punches 4*a*, 4*b* and electrically sintered (see FIG. 3*b*). So that, the solid layer 25 of the metal powder material may be sintered integrally to the metal plate 30 (see FIG. 3*c*).

Alternatively, if a much smaller amount (relative to the amounts employed in embodiment 1 or 2) of the metal powder material is placed in the form of a thin layer between the punches 4*a*, 4*b* and electrically sintered, an aluminum alloy preform in the form of a thin plate having thickness of 1 mm or less may be formed.

(Electrical Sintering Method and its Apparatus)

Figure 4:
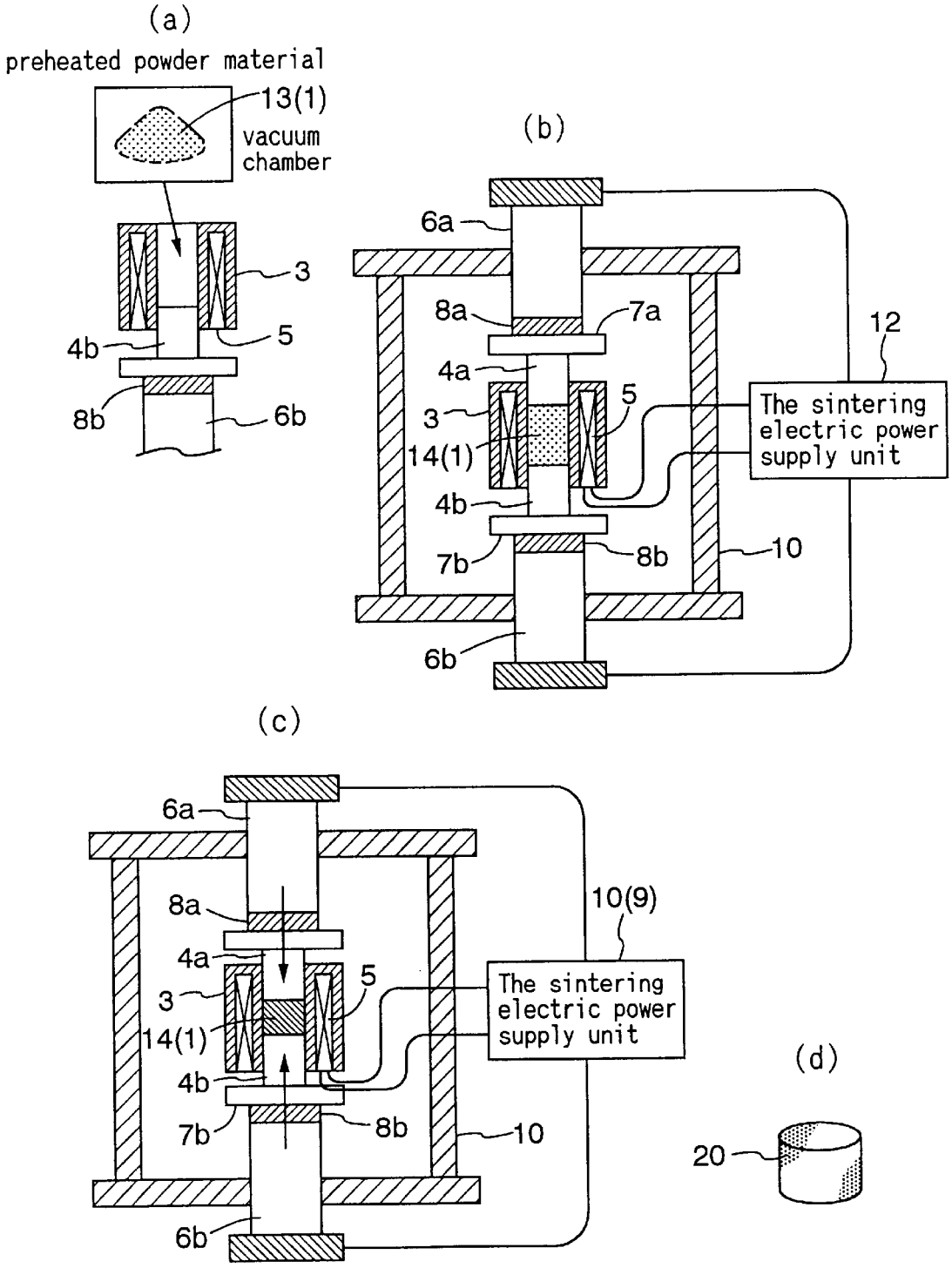
FIG. 4 is a conceptual view of a further pulsating electric current sintering apparatus.

Next, an embodiment of the electric sintering method relating to the present invention will be described in details with reference to the accompanying drawings. FIG. 4 is an explanatory view of an electric sintering apparatus for use in an electric sintering method relating to this invention.

In the case of the electric sintering apparatus shown in FIG. 4, in addition to the punch electrodes 8*a*, 8*b*, the apparatus further includes second heating means 5 capable of heating the powder material 1 charged into the sintering die 3, the second heating means 5 comprising e.g. embedded heating element.

In this case, the sintering electric power supply unit 12 is adapted to be capable of supplying electric power also to this second heating means 5 embedded within the sintering die 3. This second heating means 5 embedded within the sintering die 3 is capable of effectively heating the inside of the sintering die 3 without discharge of much heat to the outside. Hence, the heating efficiency may be improved. If the sintering die 3 is formed of such material having heat-shock resistance (e.g. cermet), the sintering die 3 may be heated rapidly. Hence, such construction will be suitable for preheating the powder material 1 within the sintering die 3 without supply of electric current or pressure thereto.

(Embodiment 1 of Electric Sintering Method and its Apparatus)

Next, there will be described a case in which the electric sintering apparatus shown in FIG. 4 is employed for sintering aluminum allow powder material 13 comprising aluminum alloy (e.g. 12% Si-Al) as an example of the powder material 1. First, while no pressure or electric current is supplied to the aluminum powder material 13, the material is preheated to 200 to 550° C. inside a vacuum chamber 10 maintained under vacuum. On the other hand, the sintering die 3 too is preheated dose to 500° C. Also, the lower punch 4*b* is inserted and maintained in advance in the preheated die 3. Then, while sintering die 3 is maintained at the predetermined preheated temperature, a predetermined amount of the aluminum allow powder material 13 is charged into the sintering die 3 (see FIG. 4*a*). Thereafter, the upper punch 4*a* is introduced from above the power material layer 14 comprising the charged aluminum allow powder material 13 to pressurize this aluminum alloy power material 13 (see FIG. 4*b*) and at the same time a voltage is impinged on the pair of upper and lower punch electrodes 8*a*, 8*b* mounted on the pair of upper and lower punches 4*a*, 4*b* so as to provide electric current to the powder material layer 14 comprising the aluminum alloy powder material 13, whereby joule heat is generated within the aluminum alloy powder material 13 per se, by which heat the material 13 is sintered (see FIG. 4*c*). Then, the lower punch 4*b* is withdrawn from the die 3 and the upper punch 4*b* is further lowered to push out the sintered compact 20 (see FIG. 4*d*). The temperature of the preheated aluminum alloy powder material 13 is lower than the fusing temperature of the powder raw material 1, but higher than 40% of the electric sintering temperature in the Celsius scale. The pressure to be applied during the supply of electric current is from 50 to 150 MPa and the sintering temperature is 550° C.

When the aluminum alloy powder material 13 is to be sintered in the above-described manner, by preheating the aluminum allow powder material 13 to 400° C., the subsequent sintering operation may be completed within 5 to 15 minutes after charging of the aluminum alloy powder material 13 into the sintering die 3. with its heating to 550° C. after the pressure application, in contrast to the conventional electric sintering process which takes about 30 minutes. The aluminum alloy powder material 13 employed in the experiment was Al-12Si alloy having an average particle diameter of 400 $\mu$m and containing 12 wt. % of silicon (the same is true with the Al-17Si type alloy). And, the heating rate after the application of pressure of 50 MPa was about 20° C./min. The resultant sintered compact 20 had substantially zero porosity.

(Embodiment 2 of Electric Sintering Method and its Apparatus)

For the purpose of performance test, by using the electric sintering apparatus shown in FIG. 4, with the sintering die 3 made in the form of a cylindrical member having an outer diameter of 150 mm, an inner diameter of 58 mm and a length of 150 mm and the upper and lower punches 4*a*, 4*b* each made in the form of a column-like member having an outer diameter of 58 mm and a length of 65 mm, aluminum allow powder material 13 of Al-12Si containing 12 wt. % of silicon was sintered. Specifically, the aluminum alloy powder material 13 was preheated to 400° C. inside the sintering die 3 disposed within the vacuum chamber 10. Then, the upper punch 4*a* was forcibly inserted into the sintering die 3, and while electric current was being applied thereto, the material was heated up to the sintering temperature with application of 50 MPa pressure thereto. The maximum sintering temperature was 500° C. and the temperature elevating rate was 20° C./min. The apparent density of the resultant sintered product was the same as that produced from the Al-12Si aluminum alloy. In this case, the conventional electric power supply unit was employed. The sintering operation according to the conventional method not involving the preheating step of the aluminum alloy powder material 13 takes 30 minutes. This was true also with the further aluminum alloy powder comprising Al-17Si containing 17 wt. % of silicon.

(Embodiment 3 of Electric Sintering Method and its Apparatus)

For the purpose of performance test, by using the electric sintering apparatus shown in FIG. 4, with the sintering die 3 made in the form of a cylindrical member having an outer diameter of 150 mm, an inner diameter of 90 mm and a length of 150 mm by using alloy tool steel material SKD61 as the raw material thereof and the upper and lower punches 4*a*, 4*b* each made in the form of a column-like member having an outer diameter of 90 mm and a length of 65 mm, aluminum alloy powder material 13 comprising Al-17Si containing 17 wt. % of silicon was sintered. Specifically, the aluminum alloy powder material 13 was preheated to 450° C. inside the sintering die 3. Then, the upper punch 4*a* was forcibly inserted into the sintering die 3, and while electric current was being applied thereto, the material was heated up to the sintering temperature with application of 150 MPa pressure thereto. The apparent density of the resultant sintered product was the same as that produced from the Al-17Si aluminum alloy. The sintering operation took about 1 minute.

(Embodiment 4 of Electric Sintering Method and its Apparatus)

For the purpose of performance test, by using the electric sintering apparatus shown in FIG. 4, with the sintering die 3 made in the form of a cylindrical member having an outer diameter of 120 mm, an inner diameter of 58 mm and a length of 150 mm by using alloy tool steel material SKD61 as the raw material thereof and the upper and lower punches 4*a*, 4*b* each made in the form of a column-like member having an outer diameter of 58 mm and a length of 65 mm, aluminum alloy powder material 13 comprising Al-17Si containing 17 wt. % of silicon was sintered. Specifically, the aluminum alloy powder material 13 was preheated to 450° C. inside the sintering die 3. Then, the upper punch 4*a* was forcibly inserted into the sintering die 3, and while electric current was being applied thereto, the material was heated up to the sintering temperature with application of 150 MPa pressure thereto. The electric current was set to about 5000A In this case, the sintering took about 2.5 minutes. The apparent density of the resultant sintered product was the same as that produced from the Al-17Si aluminum alloy. Another experiment was conducted under the same conditions as above, except for the electric current which was set this time to about 10000A In this case, the sintering operation took about 1 minute. From these, it may be understood that the sintering time period may be reduced by increasing the electric current to be impinged on the material.

(Other Embodiments of the Electric Sintering Method and Apparatus)

<1> In the above embodiment, the second heating means 5 is embedded within the sintering die 3. Instead, this second heating means 5 may be disposed around the outer periphery of the sintering die 3. For instance, the sintering die 3 may be disposed inside a muffle furnace.

<2> In the above embodiment, the pair of upper and lower punches 4*a*, 4*b* are inserted into the sintering die 3 from the above and under. Instead, the sintering die 3 may be provided with a bottom, so that the pressurizing operation will take place with insertion of the upper punch 4*a* from the above alone. In this case, the lower punch electrode 8*b* may be disposed on the bottom of the sintering die 3.

<3> In the foregoing embodiments, the sintering die 3 is made of material having high heat resistance or high heat-shock resistance. The die may be formed of any other material having the required properties. Especially, since the sintering temperature may be lowered in the case of this invention's method, heat resistance requirement may be alleviated compared with the conventional method, although high electrical resistivity will still be required.

<4> In the foregoing embodiments, the punches 4*a*, 4*b* are formed of heat-resistant material having electroconductivity such as tungsten, molybdenum, etc. The punches may be formed of any other material having the required properties. Especially, since the sintering temperature may be lowered in the case of this invention's method, heat resistance requirement may be alleviated compared with the conventional method, although high electrical resistivity will still be required.

<5> In the case of the electric sintering apparatus of the type including the second heating means 5, at least one, preferably a front portion thereof, of the sintering die 3 and the upper and lower punches 4*a*, 4*b* of the mold 2 may be provided in the form of a compact made of the material containing electroconductive metal boride, such as the compact of titanium diboride ($TiB_2$) described hereinbefore. With this, there may be obtained an electric sintering apparatus capable of providing hundreds of cycles of electric sintering and mold releasing operations without any application at all of releasing agent to the inner mold surface or elsewhere.

<6> In the foregoing embodiments, the aluminum alloy powder material 13 is preheated to 200 to 550° C. inside the vacuum chamber 10 maintained under vacuum. Instead, the powder material 1 may be preheated inside the sintering die 3 before the upper punch 4*a* is inserted into the die 3 after charging of the material 1 into this die 3.

<7> In the foregoing embodiments, the aluminum alloy powder material 13 is preheated and sintered inside the vacuum chamber 10 maintained under vacuum. Instead, the powder material 1 may be preheated in an inactive atmosphere or in the aerial atmosphere. And, its sintering operation too may be carried out in such inactive atmosphere or in the aerial atmosphere.

In addition to the above-described aluminum alloy powder materials such as the Al-12Si alloy, Al-17Si alloy, it is also possible to employ other metal or alloy powder materials comprising e.g. magnesium or mixtures thereof, or mixtures of such metal powder materials, or mixture materials of the above-described metal composition containing non-metal refractory material (e.g. oxide such as $SiO_2$, $Al_2O_3$, etc; carbide such as SiC; nitride such as SIALON, $Si_3N_4$, etc.) by such an amount not interfering with the electric sintering process.

Further, the powder material 1 may comprise mixture material of more than two kinds of aluminum alloy powder materials each of which contains 1 to 15 wt. % of one or more than two kinds of transition metal elements selected from the group consisting of Fe, Cr, Ni, Zr, Mn and Mo, 10 to 30 wt. % of Si, 0.5 to 5 wt. % of Cu, 1 to 5 wt. % of Mg and the remainder portion of Al, and having a crystal particle diameter greater than 0.05 $\mu$m and smaller than 2 $\mu$m and a powder particle diameter greater than 50 $\mu$m and smaller than 1000 $\mu$m, the two or more kinds of the aluminum alloy powder materials being different in the contents of the transition metal element(s) from each other. With this, the sintered compact may obtain high-strain-rate superplastic property. Also, such sintered compact may be machined at a high speed characterized by a strain forming rate $(\epsilon)10^{-2}$/sec and it exhibits, under this forming condition, an extremely high ductility of elongation rate of about 200% or higher and an extremely low deformation fluidization stress of about 20 MPa or lower. Hence, such material allows efficient compression plastic deformation under high-speed and low-pressure conditions. Therefore, if the aluminum alloy powder material which contains a large amount of the transition metal element(s), Fe or the like, by 5 to 15 wt. % is sintered and this sintered body or compact is subjected to the above-described high-speed plastic forming operation, a compact, as e.g. a piston component, having superior high-temperature resistance and friction resistance may be obtained.

In the foregoing embodiments, the electric sintering mold 2 includes the cylindrically formed sintering die 3 and the column-like punches 4*a*, 4*b*. However, the specific shape of the sintering die 3 should be adapted to the shape of the sintered body to be obtained, and the specific shape of the punches 4*a*, 4*b* too should be adapted to the shape of the sintered body 20 to be obtained. Therefore, the specific shape of these components may vary according to the need.

The invention has been described in connection particular embodiments thereof with the accompanying drawings. It should be noted however, the invention is not to be limited to the specific constructions described in the disclosed embodiments or shown in the drawings, as various modifications thereof will be apparent for one skilled in the art without departing from the essential spirit of the present invention which is defined by the appended claims for a patent application.

What is claimed is:

1. An electric sintering mold comprising:

a clamping portion for clamping a powder material, the material clamped by the clamping portion being subjected to a pressure from pressurizer and a pulsating electric current externally supplied, so that joule heat is generated within the material for sintering the material;

wherein said mold is formed of material containing metal boride having electroconductivity.

2. An electric sintering mold comprising:

a die defining a cavity for receiving a powder material therein;

a punch capable of advancing into said cavity;

the powder material received in the cavity being subjected to a pressure via said punch from a pressurizer and a pulsating electric current externally supplied, so that joule heat is generated within the material for sintering the material;

wherein at least one of said punch and said die is formed of material containing metal boride having electroconductivity.

3. The electric sintering mold according to claim 1, wherein said material forming said mold has an electric resistivity ranging from $10\times10^{-7}$ to $10\times10^{-1}$ (Ωcm).

4. The electric sintering mold according to claim 1, wherein said material forming said mold has Vickers hardness ranging from 10 to 50 (GPa).

5. The electric sintering mold according to claim 1, wherein said metal boride comprises titanium diboride.

6. An electric sintering method comprising the steps of: applying a pressure to a powder material received within a cavity defined in a die by a pressurizer; and externally supplying a pulsating electric current to said powder material, so that joule heat is generated within the material for sintering the material;

wherein the method comprises the further step of charging said powder material into said die after preheating the powder material with a second heating means prior to the sintering operation thereof within the die.

7. The electric sintering method according to claim 6, wherein said preheating step is effected to a temperature which is below the fusing temperature of the powder material and which is higher than 40% of the electric sintering temperature in the Celsius scale.

8. The electric sintering method according to claim 6, wherein said preheating step is effected on the die holding the powder material therein prior to its electric sintering operation.

9. An electric sintering apparatus comprising:

a die defining a cavity capable of receiving a powder material therein;

a punch capable of advancing into the cavity;

an electric power supply unit capable of supplying a pulsating electric current; and a pair of electrodes capable of communicating the electric current to the powder material received in the cavity of the die, the electrodes receiving the pulsating electric current from the electric power supply unit;

the powder material received in the cavity being subjected to a pressure via said punch from a pressurizer and the pulsating electric current externally from the electrodes, so that joule heat is generated within the material for sintering the material;

wherein said die includes second heating means capable of preheating the die per se before the powder material is charged therein.

10. The electric sintering apparatus according to claim 9, wherein at least one of said punch and said die is formed of material containing metal boride having electroconductivity.

* * * * *

UNITED STATES PATENT AND TRADEMARK OFFICE

CERTIFICATE OF CORRECTION

PATENT NO. : 6,371,746 B1
DATED : April 16, 2002
INVENTOR(S) : Yasuaki Shiomi et al.

It is certified that error appears in the above-identified patent and that said Letters Patent is hereby corrected as shown below:

Column 9,
Line 52, "dose to 500ºC" should read -- close to 500ºC --.

Column 11,
Line 23, after "about 5000A" insert period (.).
Line 29, after "about 10000A" insert period (.).

Column 14,
Line 7, after "powder material" delete "with a second heating means".

Signed and Sealed this

Eighth Day of October, 2002

*Attest:*

*Attesting Officer*

JAMES E. ROGAN
*Director of the United States Patent and Trademark Office*